United States Patent [19]

Ouchi et al.

[11] Patent Number: 4,799,975

[45] Date of Patent: Jan. 24, 1989

[54] METHOD FOR PRODUCING BETA TYPE TITANIUM ALLOY MATERIALS HAVING EXCELLENT STRENGTH AND ELONGATION

[75] Inventors: Chiaki Ouchi; Yohji Kohsaka; Hiroyoshi Suenaga, all of Tokyo; Hideo Sakuyama; Hideo Takatori, both of Kanagawa, all of Japan

[73] Assignees: Nippon Kokan Kabushiki Kaisha; Nippon Mining Co., Ltd., both of Tokyo, Japan

[21] Appl. No.: 99,537

[22] Filed: Sep. 22, 1987

[30] Foreign Application Priority Data

Oct. 7, 1986 [JP] Japan ..... 61-237140
Jan. 27, 1987 [JP] Japan ..... 62-15150

[51] Int. Cl.[4] ..... C22F 1/18; C22C 14/00

[52] U.S. Cl. ..... 148/12.7 B; 148/11.5 F; 148/133

[58] Field of Search ..... 148/133, 12.7 B, 11.5 F

[56] References Cited

U.S. PATENT DOCUMENTS

| | | | |
|---|---|---|---|
| 3,156,590 | 11/1964 | Vordahl | 148/12.7 B |
| 3,436,277 | 4/1969 | Bomberger, Jr. et al. | 148/133 |
| 3,686,041 | 8/1972 | Lee | 148/11.5 F |
| 3,794,528 | 2/1974 | Rosales et al. | 148/12.7 B |
| 4,600,449 | 7/1986 | White et al. | 148/12.7 B |
| 4,675,055 | 6/1987 | Ouchi et al. | 148/11.5 F |

FOREIGN PATENT DOCUMENTS

| | | | |
|---|---|---|---|
| 0675383 | 12/1963 | Canada | 148/12.7 B |
| 0501114 | 10/1976 | U.S.S.R. | 148/133 |

OTHER PUBLICATIONS

Avery et al. in Titanium Science & Tech. ed. Jaffee et al., Plenum, N.Y. 1973, vol. 3, p. 1829.

*Primary Examiner*—Upendra Roy
*Attorney, Agent, or Firm*—Henry C. Nields

[57] ABSTRACT

A $\beta$ type titanium alloy material is passed through processes and heating treatments of cold working—intermediate solution treatment—final cold working—final solution treatment—aging. In this process, a structure, which has been provided with strains by the cold working performed prior to the final cold working, will be changed into a recrystallized structure by carrying out the intermediate solution treatment, where uniform and fine micro substructure of dislocations, remain with grains. If such an intermediate solution-treated material is processed with a slight cold working by the final cold working and further with the solution treatment, only a recovery phenomenon progresses, and it is possible to provide such a micro substructure containing more uniform and finer dislocation network not only in grains but also in grain boundaries. Therefore, in the aging, expedition of precipitation and uniform distribution of $\alpha$ crystals will be realized in the grains and grain boundary regions, and intergranular cracking is difficult to take place, and alloy materials having high strength and high ductility may be produced.

20 Claims, 1 Drawing Sheet

METHOD FOR PRODUCING BETA TYPE TITANIUM ALLOY MATERIALS HAVING EXCELLENT STRENGTH AND ELONGATION

BRIEF DESCRIPTION OF THE INVENTION

The invention relates to a method for producing $\beta$ type titanium alloy material having excellent high strength and high ductility, in which a $\beta$ type titanium alloy material is passed through mechanical processes and heating treatments of cold working —intermediate solution treatment—final cold working—final solution treatment—aging. In this process, a structure, which has been provided with strains by the cold working performed prior to the final cold working, will be changed into a recrystallized structure by carrying out the intermediate solution treatment, where uniform and fine micro substructure of dislocations remains within grains. If such an intermediate solutiontreated material is performed with a slight cold working by the final cold working and further with the solution treatment only a recovery phenomenon progresses, it is possible to provide such a micro substructure containing more uniform and finer dislocation network not only in grains but also in grain boundary regions. Therefore, in the aging, expedition of precipitation and uniform distribution of $\alpha$ crystals may be realized in the grains and grain boundary regions. As a result, intergranular cracking is difficult to take place, and alloy materials of higher strength and higher ductility than the prior art may be produced (strength: more than 170 kilogram force (kgf)/mm$^2$ and elongation: more than 5%).

BACKGROUND OF THE INVENTION $\beta$ type titanium alloys such as Ti-15%V-3%Cr-3%Sn-3%Al, or Ti-3%Al-8%V-6%CR-4%Mo-4%Zr are excellent in cold workability, and are sometimes used for cold rolled thin plates, cold drawn bars or wire materials. The strength of these $\beta$ type titanium alloy materials is increased as the degree of cold working is increased. As a result, for example, in Ti-15%V-3%Cr-3%Sn-3%Al alloy, the maximum strength may exceed 165 kgf/mm$^2$. However, elongation in this case is at most about 1%. Since the ductility is decreased as the strength is increased, heat treating conditions are selected which may maintain the elongation value while controlling the strength in practice.

The cold worked material of $\beta$ type titanium alloy is subjected to the solution treatment—aging treatment after the cold working, or the cold working—aging treatment. If the cold worked strain is kept as cold worked or the solution temperature is low enough to retain most of the cold worked strain, precipitation of crystal is accelerated and refined in the aging, so that it is possible to increase the strength while increasing the cold reduction. On the other hand, since the precipitation of $\alpha$ phase particle in the grain boundary is remarkably expedited in comparison with interiors of the crystal grain together with increasing the degree of cold working, the grain boundary is easily destroyed as the degree of cold working is decreased. Therefore, in the cold worked material by the prior art, the strengh is limited to the 165 Kgf/mm$^2$, and the high strength material has low elongation value.

The present invention is to provide a method for producing titanium alloy materials without conventional defects.

It is an object of the invention to provide a method for producing $\beta$ type titanium alloy materials enriched with high strength and ductility.

It is another object of the invention to provide a method for producing $\beta$ type titanium alloy materials having high strength and ductility, irrespectively of plate thickness.

SUMMARY OF THE INVENTION

The invention subjects a $\beta$ type titanium alloy material to a cold working at more than 30%, an intermediate solution treatment at a temperature of higher than $\beta$ transus temperature, a final cold working between more than 3% and less than 30%, and finally to a final solution treatment and aging treatment.

With respect to the intermediate solution treatment, upper limits are determined to the treating temperature and the treating time in order to maintain effects of refining grains generated through the cold working. That is, the intermediate solution treatment is preferably carried out within a temperature range of $T_\beta$ to $T_\beta+200°$ C. ($T_\beta$: $\beta$ transus temperature) and within a period of time of $60-1/5(Ts-T_\beta)$ (Ts: intermediate solution treatment temperature).

Under the above mentioned conditions, sufficient effects may be obtained to thin plates of less than 2 mm in thickness, though if a plate thickness is more than 2 mm, the effects would not be uniform. For providing high strength and high value of elongation, irrespectively of plate thickness, the treating conditions must be more severely determined. The $\beta$ titanium alloy material is passed through the cold working at more than 30%, recrystallized by increasing the temperature at a heating rate of faster than 2° C./sec to higher than the $\beta$ transus temperature, and cooled down to the temperature of not higher than 300° C. Thus the intermediate solution treatment is finished. Subsequently, said material is passed through the final cold working at a degree of cold working of between 3% and 30%, and is followed by final solution treatment. Final solution treatment consists of heating up to a temperature of higher than $\beta$ transus temperature at heating rate of faster than 2° C./sec, keeping at the temperature for some period, and cooling down to a temperature of lower than 300° C. at a cooling rate of faster than 2° C./sec. Aging treatment will follow for obtaining high strength.

DETAILED DESCRIPTION OF THE INVENTION

Figure 1:
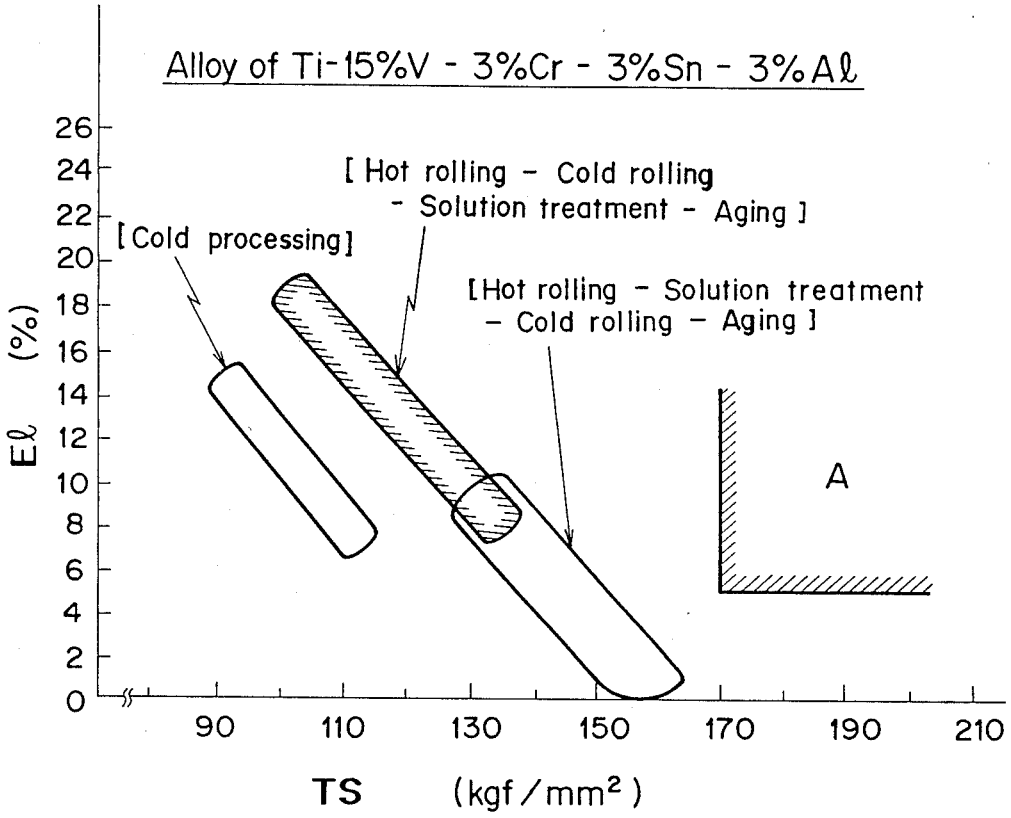
FIG. 1 shows balance between strength and elongation of titanium alloy material produced by the present invention together with balance between strength and elongation of titanium alloy material produced by the conventional methods.

The present invention will be explained in detail together with limiting reasons therefor.

In the invention, beta type titanium alloy products which have been hot rolled or hot rolled, cold rolled and intermediately solution treated for more than once, are subjected to the cold working (prior to a final cold working) of more than 30% of degree of cold working (in case of cold rolling, it is reduction).

The reason for specifying the degree of cold working as more the 30% prior to the final cold working, is because if it were less than 30%, recrystallization would not be expedited during the intermediate solution treatment, and not only final products would have coarse grains, but also distribution of residual strain of the cold working after the intermediate solution would be irregular with coarse density. Due to said irregularity, strains of the cold working would be irregular in distribution and coarse in density, consequently, the strain after final solution treatment would be also irregular. Therefore, it is impossible to provide such cold worked materials having high strength and high ductility after aging.

After said cold working, the intermediate solution treatment is performed at a range of higher than $\beta$ transus temperature, especially at a temperature range of $T_\beta$ to $T_{62}+200°$ C. ($T_\beta$: $\beta$ transus temperature) and within a period of time of $60-1/5(Ts-T_\beta)$ (Ts: intermediate solution treatment temperature).

The reason for providing upper limits to the intermediate solution temperature and time, is because if said temperature and time exceeded said limits, recrystallization would be completed and grains would grow, and not only refining effect by the cold working would be lost, but residual strain of the cold working would be lost, and material characteristics of the high strength and high ductility of the final aged material would be nullified.

As seen above, after the intermediate solution treatment, the final cold working is done at the degree of between more than 3% and less than 30% (in the case of cold rolling, it is reduction).

The reason for specifying the degree of the final cold working at more than 3%, is because if it were less than 3%, the strain of the cold working would be irregularly distributed, so that $\beta$ phase would be precipitated irregularly in the final aged material, and the high strength and high ductility are lost. On the other hand, the reason for specifying the degree of final cold reduction less than 30% is because if it were more than 30%, recrystallization would be expedited during the final solution treatment, and effect of giving strain of the cold working by the final cold working would be lost.

The cold worked material is, after the final cold working, undertaken with the final solution treatment and the aging treatment.

The reason for specifying the reheating temperature for the intermediate and final solutions at a temperature of higher than $\beta$ transus temperature is because if it were lower than the $\beta$ transus temperature, $\alpha$ crystal would be precipitated during the solution treatment.

With respect to the thin plates having thickness of less than 2 mm, satisfied effects would be available under the above mentioned condition, but if the thickness exceeds 2 mm, the satisfied effects could not be obtained constantly. For providing the high strength and high ductility, irrespectively of the plate thickness, the treating conditions must be severely specified.

That is, in the intermediate solution treatment, the temperature is increased to the range of more than the $\beta$ transus temperature at the heating rate of more than 2° C./sec, and after completion of the recyrstallization the temperature is lowered not higher than 300° C. at the cooling rate of faster than 2° C./sec. Further in the final solution treatment, the temperature is increased to a temperature of higher than $\beta$ transus temperature at the heating rate of faster than 2° C./sec, and the temperature is lowered to not higher than 300° C. at the cooling rate of faster than 2° C./sec.

The reason of specifying the conditions is to intend control of the heating and cooling rates such that $\alpha$ crystal would precipitate during neither heating nor cooling through $\alpha+\beta$ region in the intermediate or final solution treatment. If the heating rate were too slow during the solution treatment, $\alpha$ crystal would be precipitated on micro-substructure in the $\alpha+\beta$ range on the way of heating to the $\beta$ phase region. Since this precipitated $\alpha$ crystal would remain for a while after the reaching of temperature to the $\beta$ phase region, the micro substructure would be destroyed in recovery phenomena thereof, and as a result the recovered structure would be non-uniform, and the precipitation of the $\alpha$ crystal during aging would be not uniform and the strength would be lowered. If the cooling rate during solution treatment were too slow, the precipitation of the $\alpha$ crystal would take place onto the recovered micro substructure, and the precipitated $\alpha$ crystal would become large during aging, so that the precipitate of $\beta$ phase during aging would be not uniform and the strength would be lowered. However, under the above stated strict conditions, the recovered uniform structure could be obtained by controlling the heating rate and the cooling rate during solution treatment, not depending upon the plate thickness.

The reason for determining the heating rate and the cooling rate at faster than 2° C./sec during the intermediate and the final solution treatments, is because if the heating rate and the cooling rate were less than 2° C./sec, the $\alpha$ crystal would be precipitated during heating and cooling, and subsequently the precipitation of the $\alpha$ crystal would become non-uniform or coarse, and the material characteristics of the high strength and the high ductility would be lost. Upper limits of the heating and cooling rates are not especially determined. If being more than 100° C./sec the materials would be deformed, so preferably the upper limits are 100° C./sec.

The cooling rates at the intermediate and final solution treatments are controlled to the temperature of not more than 300° C., because if the cooling rate were controlled to the temperature of more than 300° C., the $\alpha$ crystal would be precipitated during the cooling to 300° C. The precipitation of the $\alpha$ crystal deteriorates the property of the final aged material as mentioned above.

The cold worked material of the conventionally foregoing $\beta$ type titanium alloy is produced through hot working—solution treatment—cold working—solution treatment—aging treatment (the solution treatments may be omitted). In the solution treatment after the cold working, the recrystallization is developed, but such a structure where uniform and fine micro substructure remain in grains, may be obtained through the selection of the conditions of solution treatment. If the solution treated material where a micro substructure of dislocation remains, is subjected to the aging treatment, expedition and uniforming of the precipitation of the $\alpha$ crystals are brought about and the cold worked material may be provided with high strength in comparison with hot worked material. In comparison with the interior of the grain, the dislocations easily cohere in the grain boundary regions, and the $\alpha$ crystals are easily precipitated during aging in lamella around the grain boundary. Therefore, in the aged material by the foregoing process, intercrystalline cracking easily takes place, and in the cold worked material of $\beta$ titanium alloy, the limit of the strength is about 165 Kgf/mm$^2$, and the value of elongation is low.

On the other hand, the present invention employs hot working—solution treatment (which may be omitted-)—cold working—intermediate solution treatment—cold working—solution treatment—aging treatment. One of the important elements is the intermediate solution treatment. The structure by the strain of the cold working before the final cold working, becomes a recrystallized structure where uniform and fine dislocated micro substructure remains in the grains by the intermediate solution treatment. If a slight cold working is added to the material with a substructure of dislocations after the intermediate solution treatment and a further solution treatment is carried out, only recovery phenomina develop a more uniform and finer micro substructure of dislocations can be obtained. Therefore, the precipitation of the $\alpha$ crystal is expedited during aging, and uniform aged structure is formed about grain boundaries and within the grains. As a result, intergranular fracture is difficult to occur, and cold rolled plates may be produced of higher strength and higher value of elongation in comparison with conventionally existing materials.

Further, with a severe control of both cold working and solution treatment after cold working (especially controlling of heating rate and cooling rate in solution treatment) it is possible to produce titanium alloy materials of $\beta$ type which are excellent in strength and elongation, if they are even large thicknesses.

The present invention is applicable not only to alloys of Ti-15%V-3%Cr-3%Sn-3%Al but general $\beta$ alloy materials such as Ti-3%Al-8%Cr-6%Cr-4%Mo-4%Zr, etc. In addition, this invention is also applicable to the production of round bar materials by cold forging, cold drawing, etc., other than the production of the cold rolled plates, which have high strength and high elongation equivalent to those of the above mentioned cold rolled products, by following the producing conditions of this invention.

By repeating the processes of the cold working—the intermediate solution treatment, the effects to be brought about by this invention could be confirmed by following the conditions of the invention in the cold working process before the final cold working process, the intermediate solution treatment before the final cold working process and the final cold working process.

EXAMPLE 1.

A cast ingot of 550 mm diameter of Ti-15%V-3%Cr-3%Sn-3%Al which is a typical $\beta$ type alloy, was heated to the temperature of 1050° C. and subjected to the hot forging to a slab of 200 mm thickness. Table 1 shows chemical composition of tested material ($T_\beta$=729° C.). Said slab was heated to the temperature of 950° C., and hot-rolled to the 20 mm thickness, and was undertaken with the solution treatment of 20 min at the temperature of 800° C. so as to produce the material for cold rolling. In the cold rolling, samples of from 2.8 mm to 20 mm were cut out from said hot rolled plate, and finished to cold rolled plates of the final thickness being 2 mm (some of them being 1 mm) through a primary cold rolling (the cold rolling prior to the final cold rolling at a reduction of between 20 and 80%) and a secondary cold rolling (the final cold rolling at a reduction of between 0 and 50%).

The final heat treating conditions of the cold rolled materials were 800° C.×20 min (the final solution treatment )—air cooling—510° C.×14 hr (aging treatment-)—air cooling. The mechanical properties of the hot treated materials were studied with tensile testing pieces of parallel portion being 12.5 mm width and 50 mm guage length cut out in L direction. Table 2 shows the cold rolling—heat treating conditions and properties of the cold rolled materials obtained thereby. It can be seen in Table 2 that the method of this invention could bring about the material properties of strength of more than 170 kgf/mm$^2$ and elongation of more than 5% (A range of FIG. 1)

TABLE 1

| (wt %) | | | | | | | | | |
|---|---|---|---|---|---|---|---|---|---|
| V | Cr | Sn | Al | Fe | O | C | N | H | Ti |
| 15.10 | 3.36 | 3.04 | 3.37 | 0.17 | 0.14 | 0.004 | 0.0080 | 0.0061 | Rest |

TABLE 2

| | Intermediate solution treatment conditions Prior to Final cold rolling | | | | | | Mechanical Properties | | |
|---|---|---|---|---|---|---|---|---|---|
| | | | | | | | YS | TS | |
| No. | A | B | C | D | E | F | (Kgf/mm$^2$) | (Kgf/mm$^2$) | El (%) |
| INVENTION | | | | | | | | | |
| 1 | 30 | 800 | 20 | 45.8 | 10 | 2 | 164.53 | 174.36 | 7.3 |
| 2 | 50 | " | " | " | " | " | 165.22 | 174.95 | 6.9 |
| 3 | 80 | " | " | " | " | " | 162.61 | 175.83 | 5.3 |
| 4 | " | 730 | " | 59.8 | " | " | 171.31 | 177.54 | 5.2 |
| 5 | " | " | 58 | " | " | " | 168.38 | 175.02 | 7.9 |
| 6 | " | 925 | 10 | 20.8 | " | " | 169.28 | 174.56 | 7.2 |
| 7 | " | " | 20 | " | " | " | 165.33 | 174.21 | 7.5 |
| 8 | " | 800 | " | 58.6 | 3 | " | 168.72 | 178.20 | 6.4 |
| 9 | " | " | " | " | 15 | " | 162.72 | 170.52 | 7.0 |
| 10 | " | " | " | " | 10 | 1 | 191.40 | 201.7 | 7.8 |
| PRIOR ART | | | | | | | | | |
| 11 | 20 | 800 | 20 | 58.6 | 10 | 2 | 146.32 | 155.92 | 6.3 |
| 12 | 27.5 | " | " | " | " | " | 147.31 | 159.10 | 6.1 |
| 13 | 80 | 725 | " | 61 | " | " | 141.33 | 153.21 | 2.3 |
| 14 | " | 730 | 65 | 59.8 | " | " | 127.56 | 139.33 | 8.2 |
| 15 | " | 925 | 25 | 20.8 | " | " | 126.38 | 138.56 | 9.3 |
| 16 | " | 930 | 10 | 19.8 | " | " | 126.53 | 137.90 | 8.1 |
| 17 | " | 800 | 20 | 58.6 | 0 | " | 121.23 | 133.00 | 6.0 |
| 18 | " | " | " | " | 2 | " | 127.62 | 140.32 | 2.3 |
| 19 | " | " | " | " | 30 | " | 125.34 | 137.11 | 5.3 |

TABLE 2-continued

| No. | A | Intermediate solution treatment conditions Prior to Final cold rolling B | C | D | E | F | Mechanical Properties YS (Kgf/mm²) | TS (Kgf/mm²) | El (%) |
|---|---|---|---|---|---|---|---|---|---|
| 20 | " | " | " | " | 50 | " | 123.14 | 135.62 | 6.2 |

Note
A: Reduction (%) in the cold rolling prior to final cold rolling
B: Solution treatment temperature (°C.)
C: Solution treatment time (min)
D: 60 - 1/5(Ts - Tβ)
E: Reduction (%) in final cold rolling
F: Plate thickness (mm)

EXAMPLE 2

Slabs were produced under the same chemical composition and conditions as Example 1, and these slabs were heated to the temperature of 950° C., and hot-rolled to the 80 mm thickness, and undertaken with the solution treatment for 20 min at the temperature of 800° C. so as to produce the material for cold rolling. In the cold rolling, samples of from 2.8 mm to 55 mm were cut out from said hot rolled plate (80 mm thickness), and finished to cold rolled plates of the final thickness being 5 mm (some of them being 10 mm) through a primary cold rolling (the cold rolling prior to the final cold rolling at a reduction of between 20 and 80%) and a secondary cold rolling (the final cold rolling at reduction between 0 and 50%).

The intermediate and final solution treating conditions were 710° C. to 900° C.×1 to 20 min, and the heating and cooling rates during the solution treatments were changed between 1.0° C./sec and 10° C./sec. The aging condition for each was 510° C.×14 hr—air cooling. The mechanical properties of the hot worked materials were studied with tensile testing pieces of parallel portion being 12.5 mm width and guage lenth cut out in L direction. Table 3 shows the cold rolling—heat treating conditions and properties of the cold rolled materials obtained thereby. It is seen from table 3 that although the thickness was more than 5 mm, the method of this invention could stably bring about the material properties of strength of more than 170 kgf/mm² and elongation of more than 5% (A range of FIG. 1) by satisfying the cold rolling and heat-treating conditions.

TABLE 3

| No. | A | Intermediate solution treatment conditions Prior to Final cold rolling G | H | I | J | E | F | Final solution treatment conditions G | H | I | J | Mechanical Properties YS (Kgf/mm²) | TS (Kgf/mm²) | El (%) |
|---|---|---|---|---|---|---|---|---|---|---|---|---|---|---|
| INVENTION | | | | | | | | | | | | | | |
| 1 | 30 | 800° C. × 20 min | 5 | 5 | 35 | 10 | 5 | 800° C. × 20 min | 5 | 5 | 35 | 164.30 | 175.31 | 7.9 |
| 2 | 50 | " | " | " | " | " | " | " | " | " | " | 164.91 | 175.63 | 6.8 |
| 3 | 80 | " | " | " | " | " | " | " | " | " | " | 162.35 | 175.91 | 5.9 |
| 4 | " | " | 2 | " | " | " | " | " | " | " | " | 171.11 | 178.20 | 5.6 |
| 5 | " | " | 5 | 2 | " | " | " | " | " | " | " | 168.19 | 176.11 | 8.0 |
| 6 | " | " | " | 5 | 300 | " | " | " | " | " | " | 169.33 | 174.32 | 7.5 |
| 7 | " | " | " | " | 35 | " | " | " | 2 | 5 | " | 165.46 | 174.02 | 7.3 |
| 8 | " | " | " | " | " | " | " | " | 5 | 2 | " | 160.10 | 173.12 | 5.7 |
| 9 | " | " | " | " | " | " | " | " | " | 5 | 300 | 166.33 | 177.11 | 7.3 |
| 10 | " | 900° C. × 1 min | " | " | " | " | " | " | " | " | " | 189.14 | 199.80 | 7.8 |
| 11 | " | " | " | " | " | " | " | 900° C. × 1 min | " | " | 100 | 164.41 | 175.31 | 5.9 |
| 12 | " | 800° C. × 20 min | " | " | " | 3 | " | 800° C. × 20 min | " | " | 35 | 168.36 | 178.31 | 6.6 |
| 13 | " | " | " | " | " | 15 | " | " | " | " | " | 162.71 | 170.63 | 7.3 |
| 14 | " | " | " | " | " | 10 | 10 | " | 5 | 5 | " | 163.91 | 174.93 | 7.7 |
| 15 | " | " | 10 | 10 | " | " | 5 | " | 10 | 10 | " | 184.33 | 194.73 | 7.5 |
| PRIOR ART | | | | | | | | | | | | | | |
| 16 | 20 | 800° C. × 20 min | 5 | 5 | 35 | 10 | 5 | 800° C. × 20 min | 5 | 5 | 35 | 145.99 | 156.12 | 6.3 |
| 17 | 27.5 | " | " | " | " | " | " | " | " | " | " | 147.10 | 160.13 | 6.2 |
| 18 | 80 | " | 1 | " | " | " | " | " | " | " | " | 141.46 | 153.20 | 3.3 |
| 19 | " | " | 5 | 1 | " | " | " | " | " | " | " | 127.43 | 138.99 | 8.8 |
| 20 | " | " | " | 5 | 315 | " | " | " | " | " | " | 126.55 | 138.21 | 9.9 |
| 21 | " | " | " | | 35 | " | " | " | 1 | 5 | " | 126.81 | 137.91 | 9.0 |
| 22 | " | " | " | " | | " | " | " | 5 | 1 | " | 121.80 | 133.88 | 6.8 |
| 23 | " | " | " | " | " | " | " | " | " | 5 | 315 | 127.93 | 141.21 | 2.0 |
| 24 | " | 710° C. × 20 min | " | " | " | " | " | " | " | " | 35 | 123.45 | 135.51 | 6.1 |
| 25 | " | 800° C. × 20 min | " | " | " | " | " | 710° C. × 20 min | " | " | " | 129.56 | 140.33 | 6.0 |
| 26 | " | " | " | " | " | 0 | " | 800° C. × 20 min | " | " | " | 121.00 | 133.36 | 6.7 |
| 27 | " | " | " | " | " | 2 | " | " | " | " | " | 127.88 | 140.33 | 2.2 |
| 28 | " | " | " | " | " | 30 | " | " | " | " | " | 125.56 | 137.20 | 5.3 |
| 29 | " | " | " | " | " | 50 | " | " | " | " | " | 123.01 | 135.81 | 6.1 |

TABLE 3-continued

| No. | A | Intermediate solution treatment conditions Prior to Final cold rolling G | H | I | J | E | F | Final solution treatment conditions G | H | I | J | Mechanical Properties YS (Kgf/mm²) | TS (Kgf/mm²) | El (%) |
|---|---|---|---|---|---|---|---|---|---|---|---|---|---|---|
| 30 | " | " | " | " | " | 10 | 10 | " | 1 | 5 | " | 125.55 | 137.30 | 3.5 |

Note
A: Reduction (%) in the cold rolling prior to final cold rolling
E: Reduction (%) in the final cold rolling
F: Plate thickness (mm)
G: Solution treatment temperature × Time
H: Heating rate (°C./sec)
I: Cooling rate (°C./sec)
J: Cooling stop temperature (°C.)

What is claimed is:

1. A method for producing β type titanium alloy materials having excellent strength and elongation, comprising a cold working at more than 30%, and intermediate solution treatment at a range of higher than β transus temperature, a final cold working between more than 3% and less than 30% and a final solution treatment and an aging treatment.

2. A method for producing beta type titanium alloy materials having excellent strength and elongation, comprising subjecting a beta type titanium alloy material to a cold working at more than 30%, after it has undergone a process consisting of a cold working—intermediate solution treatment more than once; subsequently to an intermediate solution treatment at a range of higher than beta transus temperature; to a final cold working between more than 3% and less than 30%; and to a final solution treatment and an aging treatment.

3. A method for producing β type titanium alloy materials having excellent strength and elongation, comprising, after a cold working at more than 30%, subjecting a β type titanium alloy materials having been solution-treated after hot working, to an intermediate solution treatment at a range of higher than β transus temperature; to a final cold working between more than 3% and less than 30%; and subsequently to a final solution treatment and an aging treatment.

4. A method for producing beta type titanium alloy materials having excellent strength and elongation, comprising subjecting a beta type titanium alloy material having been solution-treated after hot working, to a cold working at more than 30%, after it has undergone a process consisting of a cold working-intermediate solution treatment more than once; to an intermediate solution treatment at a range of higher than beta transus temperature; to a final cold working between more than 3% and less than 30%; and subsequently to a final solution treatment and an aging treatment.

5. A method for producing β type titanium alloy materials having excellent strength and elongation, comprising, after cold working at more than 30%; heating a β type titanium alloy material to a range of more than β transus temperature at heating rate of more than 2° C./sec; and after completion of recrystallization, cooling said alloy to a temperature of not higher than 300° C. at cooling rate of more than 2° C./sec so as to finish an intermediate solution treatment; carrying out a final cold working between more than 3% and less than 30%; and in a subsequent final solution treatment, heating to a range of more than β transus temperature at heating rate of 2° C./sec, and cooling to a temperature of not higher than 300° C. at cooling rate of higher than 2° C./sec; and carrying out an aging treatment.

6. A method for producing β type titanium alloy materials having excellent strength and elongation, comprising cold working a β type titanium alloy material at more than 30%, after more than once of a process consisting of a cold working—intermediate solution treatment; heating it to a range of more than β transus temperature at heating rate of faster than 2° C./sec; and after completion of recrystallization, cooling said alloy to the temperature of not more than 300° C. at cooling rate of faster than 2° C./sec so as to finish an intermediate solution treatment; carrying out a final cold working at degree between more than 3% and less than 30%; and in a subsequent final solution treatment, heating to a range of higher than β transus temperature at heating rate of faster than 2° C./sec, and cooling to a temperature of not higher than 300° C. at cooling rate of faster than 2° C./sec; and carrying out an aging treatment.

7. A method for producing β type titanium alloy materials having excellent strength and elongation, comprising subjecting, a β type titanium alloy materials having been solution-treated after hot working, to a cold working at more than 30%; heating said alloy at a range of higher than β transus temperature at heating rate of faster than 2° C./sec; and after completion of recrystallization, cooling said alloy to a temperature of not higher than 300° C. at cooling rate of faster than 2° C./sec so as to finish an intermediate solution treatment; carrying out a final cold working between more than 3% and less than 30%; and in a subsequent final solution treatment, heating to range of higher than β transus temperature at heating rate of faster than 2° C./sec, and cooling to a temperature of not higher than 300° C. at cooling rate of faster than 2° C./sec; and carrying out an aging treatment.

8. A method for producing β type titanium alloy materials having excellent strength and elongation, comprising subjecting, a β type titanium alloy materials having been solution-treated after hot working, to a cold working at higher than 30%; heating said alloy to a range of higher than β transus temperature, after more than once of a process consisting of a cold working—intermediate solution treatment; and after completion of recrystallization, cooling said alloy to a temperature of not higher than 300° C. at cooling rate of faster than 2° C./sec so as to finish an intermediate solution treatment; carrying out a final cold working between more than 3% and less than 30%; and in a subsequent final solution treatment, heating to a range of higher than β transus temperature at heating rate of faster than 2° C./sec, and cooling to a temperature of not higher than 300° C. at cooling rate of faster than 2° C./sec; and carrying out an aging treatment.

9. A method as claimed in claim 1, comprising before the final cold working, carrying out the intermediate solution treatment at a temperature range of Tβ to $T_\beta+200°$ C. for a period of time of $60-1/5\ (Ts-T\beta)$ minutes, wherein $T\beta$ is the transus temperature and Ts is the intermediate solution treatment temperature.

10. A method as claimed in claim 2, comprising before the final cold working, carrying out the intermediate solution treatment at a temperature range of $T\beta$ to $T_\beta+200°$ C. for a period of time of $60-1/5(Ts-T\beta)$ minutes, wherein $T\beta$ is the transus temperature and Ts is the intermediate solution treatment temperature.

11. A method as claimed in claim 3, comprising before the final cold working, carrying out the intermediate solution treatment at a temperature range of $T\beta$ to $T_\beta+200°$ C. for a period of time of $60-1/5(Ts-T\beta)$ minutes, wherein $T\beta$ is the transus temperature and Ts is the intermediate solution treatment temperature.

12. A method as claimed in claim 4, comprising before the final cold working, carrying out the intermediate solution treatment at a temperature range of $T\beta$ to $T_\beta+200°$ C. for a period of time of $60-1/5(Ts-T\beta)$ minutes, wherein $T\beta$ is the transus temperature and Ts is the intermediate solution treatment temperature.

13. A method as claimed in claim 5, comprising before the final cold working, carrying out the intermediate solution treatment at a temperature range of $T\beta$ to $T_\beta+200°$ C. for a period of time of $60-1/5(Ts-T\beta)$ minutes, wherein $T\beta$ is the transus temperature and Ts is the intermediate solution treatment temperature.

14. A method as claimed in claim 6, comprising before the final cold working, carrying out the intemediate solution treatment at a temperature range of $T\beta$ to $T_\beta+200°$ C. for a period of time of $60-1/5\ (Ts-T\beta)$ minutes, wherein $T\beta$ is the transus temperature and Ts is the intermediate solution treatment temperature.

15. A method as claimed in claim 7, comprising before the final cold working, carrying out the intermediate solution treatment at a temperature range of $T\beta$ to $T_\beta+200°$ C. for a period of time of $60-1/5\ (Ts-T\beta)$ minutes, wherein $T\beta$ is the transus temperature and Ts is the intermediate solution treatment temperature.

16. A method as claimed in claim 8, comprising before the final cold working, carrying out the intermediate solution treatment at a temperature range of $T\beta$ to $T_\beta+200°$ C. for a period of time of $60-1/5\ (Ts-T\beta)$ minutes, wherein $T\beta$ is the transus temperature and Ts is the intermediate solution treatment temperature.

17. A method as claimed in claim 1, 2, 3, 4, 9, 10, 11, 12, wherein the cold working is a cold rolling.

18. A method as claimed in claim 1, 2, 3, 4, 9, 10, 11, 12, wherein the cold working is other than a cold rolling.

19. A method as claimed in claim 5, 6, 7, 8., 13, 14, 15 or 16, wherein the cold working is a cold rolling.

20. A method as claimed in claim 5, 6, 7, 8, 13, 14, 15 or 16, wherein the cold working is other than a cold rolling.

* * * * *